US006159343A

United States Patent [19]

Deshpande

[11] Patent Number: 6,159,343

[45] Date of Patent: Dec. 12, 2000

[54] PRESS-TO-DRYER APPARATUS

[75] Inventor: Rajendra D. Deshpande, Rockton, Ill.

[73] Assignee: Beloit Technologies, Inc., Wilmington, Del.

[21] Appl. No.: 09/111,581

[22] Filed: Jul. 8, 1998

[51] Int. Cl.[7] ..... D21F 3/00

[52] U.S. Cl. ..... 162/359.1; 162/375; 162/381; 34/116

[58] Field of Search ..... 162/358.1, 359.1, 162/375, 381; 34/115, 116

[56] References Cited

U.S. PATENT DOCUMENTS

| | | | |
|---|---|---|---|
| 5,090,898 | 2/1992 | Smeth | 431/326 |
| 5,600,898 | 2/1997 | Deshpande | 34/116 |
| 5,670,023 | 9/1997 | Steiner et al. | 162/359.1 |

*Primary Examiner*—Stanley S. Silverman
*Assistant Examiner*—Robert McBride
*Attorney, Agent, or Firm*—Lathrop & Clark LLP

[57] ABSTRACT

A press-to-dryer apparatus is disclosed for pressing and drying a web of paper. The apparatus includes a press for pressing the web of paper and a dryer disposed downstream relative to the press for drying the web. The dryer includes an unfelted drying cylinder disposed immediately downstream relative to the press. The arrangement is such that the web extends from the press to and around the drying cylinder. The dryer also includes a heater which cooperates with the unfelted drying cylinder such that the web is disposed between the drying cylinder and the heater for heating and drying the web. The dryer also includes a single-tier drying section which is disposed downstream relative to the unfelted drying cylinder for completing the drying of the web.

10 Claims, 2 Drawing Sheets

PRESS-TO-DRYER APPARATUS

BACKGROUND OF THE INVENTION

1. Field of the Invention

The present invention relates to a press-to-dryer apparatus for pressing and drying a web of paper.

More specifically, the present invention relates to a press-to-dryer apparatus which includes a single-tier drying section.

2. Information Disclosure Statement

In the papermaking art, a formed web of paper is transferred to a press section for pressing a large portion of water from the formed web. Subsequently, the pressed web is transferred to a drying section which includes 20 or more steam heated drying cylinders for drying the pressed web.

However, in view of the demand for ever higher machine speeds, there has existed a need for extra dryer cylinders for completing the drying process.

The present invention provides a particularly compact means for completing the pressing and drying of a formed web by including a press roll which cooperates with an unfelted drying cylinder, and by the provision of extremely large diameter drying cylinders.

Therefore, it is a primary objective of the present to overcome the aforementioned inadequacies of the prior art arrangements and to provide a considerable contribution to the art of papermaking.

Other objects and advantages of the present invention will be readily apparent to those skilled in the art by consideration of the detailed description contained hereinafter taken in conjunction with the annexed drawings.

SUMMARY OF THE INVENTION

The present invention relates to a press-to-dryer apparatus for pressing and drying a web of paper. The apparatus includes a pressing means for pressing the web of paper and a dryer means which is disposed downstream relative to the pressing means for drying the web. The dryer means includes an unfelted drying cylinder which is disposed immediately downstream relative to the pressing means. The arrangement is such that the web extends from the pressing means to and around the drying cylinder.

Heating means cooperate with the unfelted drying cylinder such that the web is disposed between the drying cylinder and heating means for heating and drying the web.

A single-tier drying section is disposed downstream relative to the unfelted drying cylinder for completing the drying of the web.

In a more specific embodiment of the present invention, the pressing means includes a smoothing press roll and a press felt.

The press felt extends around the press roll for supporting and guiding the web around the press roll and through a smoothing press nip defined between the press roll and the unfelted drying cylinder. The arrangement is such that the web is pressed during transit thereof through the nip and for imparting a smooth surface to a side of the web which comes into direct contact with a smooth circumferential surface defined by the unfelted drying cylinder.

The dryer means includes only one unfelted drying cylinder, and the single-tier drying section has two to three dryer cylinders.

More specifically, the single-tier drying section includes a dryer felt which is common to all of the dryer cylinders.

Additionally, the single-tier drying section includes double turning rolls which are disposed between each adjacent dryer cylinder for guiding the dryer felt and the web supported thereon between adjacent dryer cylinders.

The unfelted drying cylinder has a diameter within the range 8 to 22 foot.

Also, the heating means includes an air cap which is connected to a source of pressurized air for impinging a stream of heated air onto the web traveling between the air cap and the drying cylinder.

In an alternative embodiment of the present invention, the heating means includes an infrared heater which is connected to a source of electrical energy for heating the web traveling between the infrared heater and the drying cylinder.

In a preferred embodiment of the present invention, the single-tier drying section is top felted for assisting in the downward removal of broke from the drying section, in the event of a web breakage.

Additionally, each of the dryer cylinders of the single-tier drying section has a diameter within the range of 8 to 22 foot.

The single-tier drying section also includes at least one air cap which cooperates with each of the dryer cylinders. The arrangement is such that the air cap is connected to a source of heated pressurized air for blowing heated air against the web, extending between the air cap and an adjacent dryer cylinder.

Many modifications and variations of the present invention will be readily apparent to the skilled in the art by consideration of the detailed description contained hereinafter, taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
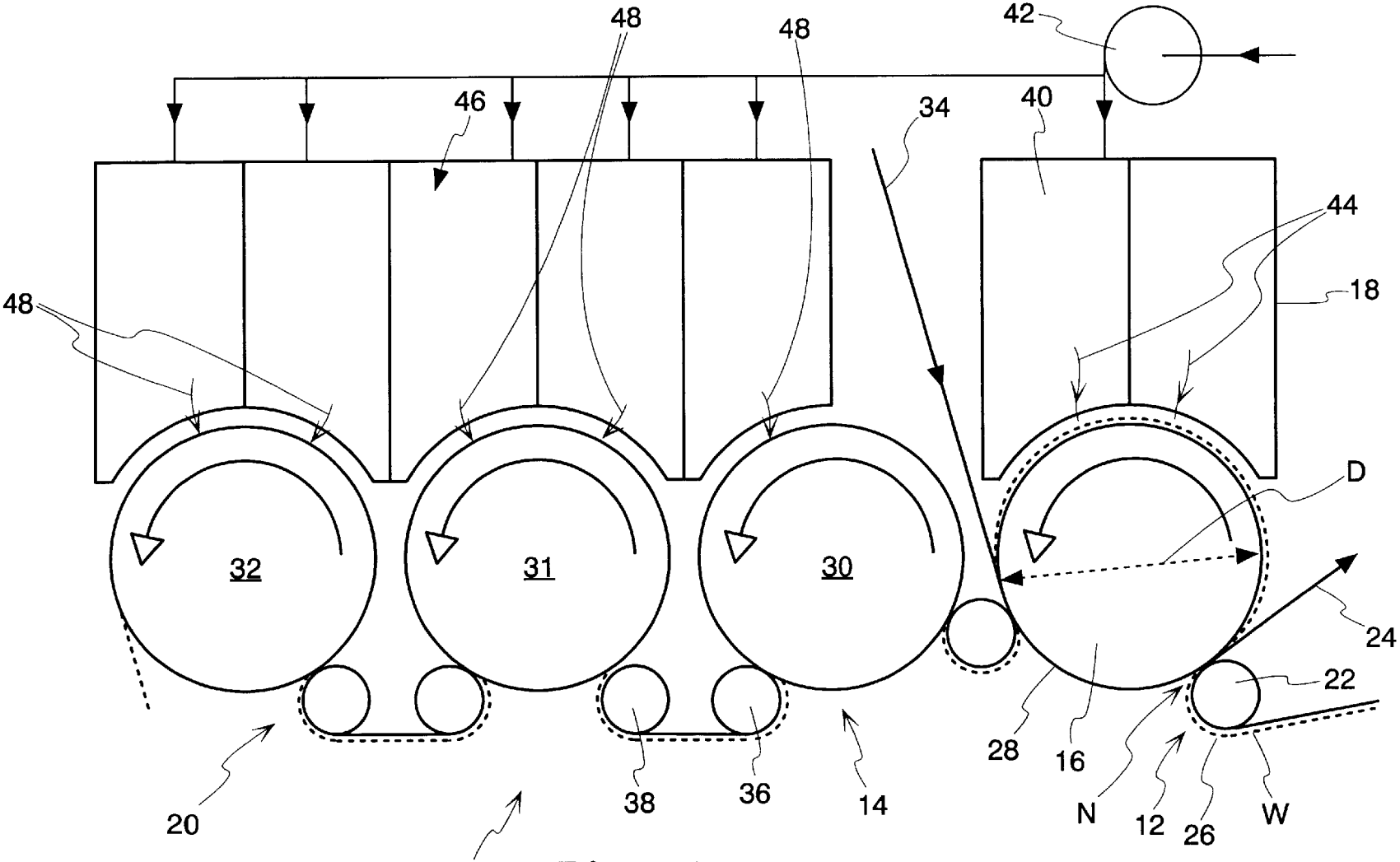
FIG. 1 is a side-elevational view of a press-to-dryer apparatus according to the present invention.

FIG. 1 is a side-elevational view of a press-to-dryer apparatus generally designated 10, according to the present invention, for pressing and drying a web W of paper.

The apparatus 10 includes pressing means generally designated 12 for pressing the web W of paper and dryer means generally designated 14 disposed downstream relative to the pressing means 12 for drying the web W.

More specifically, the dryer means 14 includes an unfelted drying cylinder 16 which is disposed immediately downstream relative to the pressing means 12. The arrangement is such that the web W extends from the pressing means 12 to and around the drying cylinder 16.

Heating means 18 cooperate with the unfelted dryer cylinder 16 such that the web W is disposed between the drying cylinder 16 and the heating means 18 for heating and drying the web W.

A single-tier drying section generally designated 20 is disposed downstream relative to the unfelted drying cylinder 16 for completing the drying of the web W.

As shown in FIG. 1, the pressing means 12 includes a smoothing press roll 22 and a press felt 24 which extends around the press roll 22. The press felt 24 supports and guides the web W around the press roll 22 and through a smoothing press nip N which is defined between the press roll 22 and the unfelted drying cylinder 16. The arrangement is such that the web W is pressed during transit thereof through the nip N and for imparting a smooth surface to a side 26 of the web W coming into direct contact with a smooth circumferential surface 28 defined by the unfelted drying cylinder 16.

The dryer means 14 includes, as shown in FIG. 1, only one unfelted drying cylinder 16. Also, the single-tier drying section 20 has three dryer cylinders 30, 31 & 32.

More particularly, the single-tier drying section 20 includes a dryer felt 34 which is common to all of the dryer cylinders 30–32.

Additionally, the single-tier drying section 20 includes double turning rolls 36 & 38 which are disposed between adjacent dryer cylinders 30 & 31 for guiding the dryer felt 34 and the web W supported thereon between adjacent dryers 30 & 31.

The unfelted drying cylinder 16 has a diameter D within a range 8 to 22 foot, and preferably within the range 12 to 20 foot.

The heating means 18 includes an air cap 40 which is connected to a source of pressurized heated air 42 for impinging a stream of heated air, as indicated by the arrow 44, onto the web W traveling between the air cap 40 and the drying cylinder 16.

Figure 2:
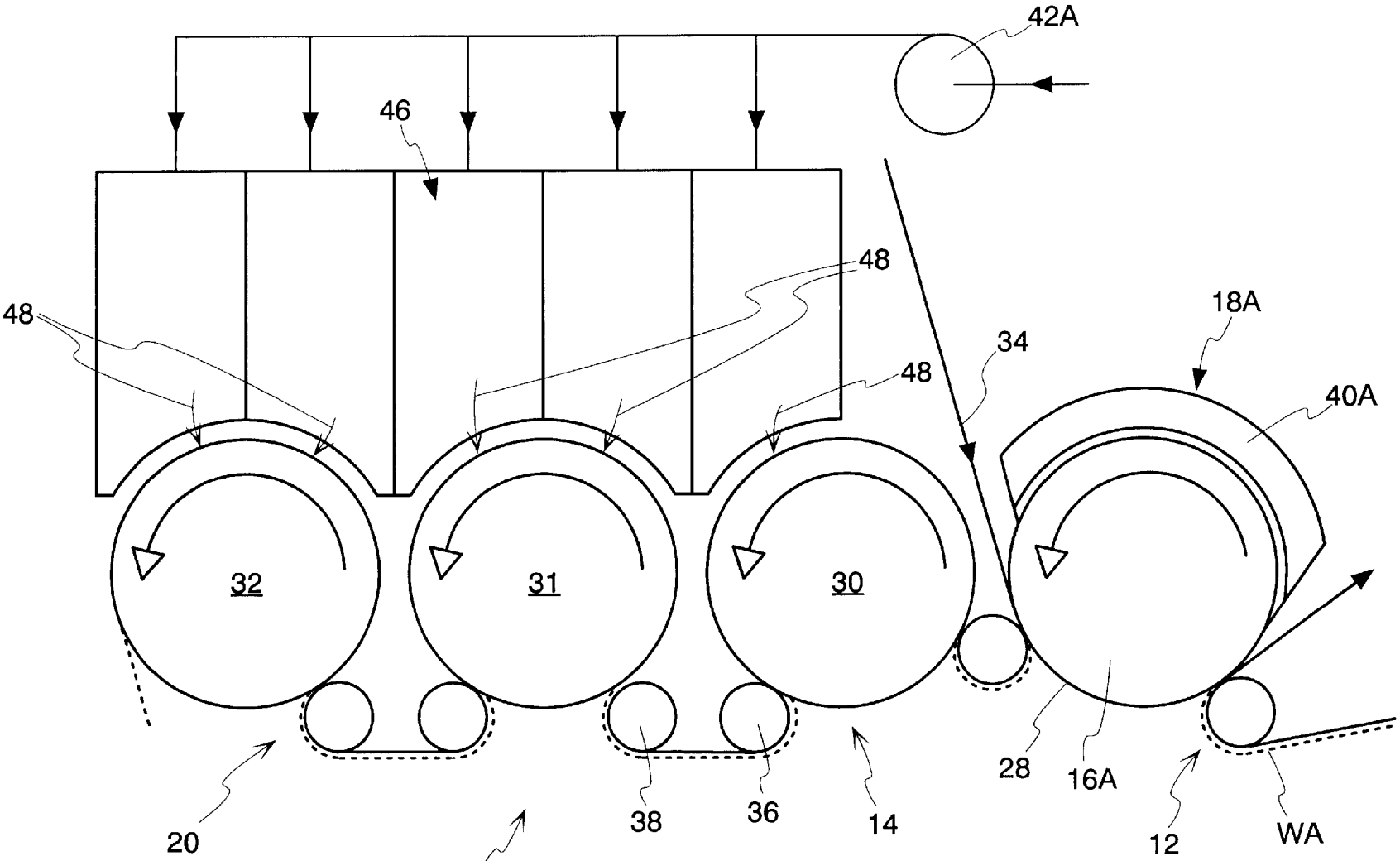
FIG. 2 is a similar view to that shown in FIG. 1, but shows an alternative embodiment of the present invention.

FIG. 2 is a side-elevational view which is similar to that shown in FIG. 1, but shows an alternative embodiment of the present invention in which the heating means 18A includes an infrared heater 40A which is connected to a source of electrical energy for heating the web WA traveling between the infrared heater 40A and the drying cylinder 16A.

As shown in FIG. 1, the single-tier drying section 20 is top felted for assisting in the removal of broke from the single-tier drying section 20 in the event of a web breakage therein.

Each of the dryer cylinders 30–32 has a diameter within the range of 8 to 22 foot, and preferably within the range of 12 to 20 foot.

Additionally, the single-tier drying section 20 further includes at least one further air cap means 46 which cooperates with each of the dryer cylinders 30–32. Each air cap of the air cap means 46 is connected to the source of heated pressurized air 42 for blowing heated air, as indicated by the arrow 48, against the web W, which extends between the air cap means 46 and an adjacent dryer cylinder of the cylinders 30–32.

The present invention provides a particularly compact press-to-dryer apparatus for completing the pressing and drying of a formed web of paper.

What is claimed is:

1. A press-to-dryer apparatus for pressing and drying a web of paper, said apparatus comprising:

pressing means for pressing the web of paper, said pressing means includes:

a smoothing press roll;

a press felt extending around said press roll for supporting and guiding the web around said press roll and through a smoothing press nip defined between said press roll and an unfelted drying cylinder so that the web is pressed during transit thereof through said nip and for imparting a smooth surface to a side of the web coming into direct contact with a smooth circumferential surface defined by said unfelted drying cylinder;

dryer means disposed downstream relative to said pressing means for drying the web;

said dryer means including:

said unfelted drying cylinder disposed immediately downstream relative to said pressing means, the arrangement being such that the web extends from said pressing means to and around said drying cylinder;

heating means cooperating with said unfelted drying cylinder such that the web is disposed between said drying cylinder and said heating means for heating and drying the web; and a single-tier dryer section disposed downstream relative to said unfelted drying cylinder for completing the drying of the web.

2. A press-to-dryer apparatus as set forth in claim 1 wherein:

said dryer means includes:

only one unfelted drying cylinder;

said single-tier drying section having two to three dryer cylinders.

3. A press-to-dryer apparatus as set forth in claim 2 wherein:

said single-tier drying section further includes:

a dryer felt which is common to all of said dryer cylinders.

4. A press-to-dryer apparatus as set forth in claim 3 wherein:

said single-tier drying section includes:

double turning rolls disposed between each adjacent dryer cylinder for guiding said dryer felt and the web supported thereon between adjacent dryer cylinders.

5. A press-to-dryer apparatus as set forth in claim 1 wherein:

said unfelted drying cylinder has a diameter within a range 8 to 22 foot.

6. A press-to-dryer apparatus as set forth in claim 1 wherein:

said heating means includes:

an air cap connected to a source of pressurized heated air for impinging a stream of heated air onto the web traveling between said air cap and said drying cylinder.

7. A press-to-dryer apparatus as set forth in claim 1 wherein:

said heating means includes:

an infrared heater connected to a source of electrical energy for heating the web traveling between said infrared heater and said drying cylinder.

8. A press-to-dryer apparatus as set forth in claim 1 wherein:

said single-tier drying section is top felted for assisting in the removal of broke.

9. A press-to-dryer apparatus as set forth in claim 1 wherein:

said single-tier drying section includes:

between two to three dryer cylinders, each dryer cylinder having a diameter within the range 8 to 22 foot.

10. A press-to-dryer apparatus as set forth in claim 1 wherein:

said single-tier drying section further includes:

a plurality of dryer cylinders;

at least one further air cap cooperating with each of said dryer cylinders of said plurality of cylinders, said further air cap being connected to a source of heated pressurized air for blowing heated air against the web extending between said further air cap and an adjacent dryer cylinder.

* * * * *